United States Patent [19]

Fresnel

[11] Patent Number: 4,993,498

[45] Date of Patent: Feb. 19, 1991

[54] APPARATUS FOR CLEANING SANDY OR PEBBLE-COVERED SITES

[76] Inventor: Jean-Marie Fresnel, Le Tiocan, les Hautes de Thoiry, F-01630 Saint-Genis-Pouilly, France

[21] Appl. No.: 194,163

[22] Filed: May 16, 1988

[51] Int. Cl.[5] ..... A01D 13/00

[52] U.S. Cl. ..... 171/25; 134/151; 111/131; 37/8; 37/4; 37/100; 405/263; 405/258

[58] Field of Search ..... 405/128, 129, 263, 258, 405/179; 209/307, 421, 420, 435; 198/509, 518, 519, 495; 134/151, 198; 37/100, 190, 8, 4; 171/63, 89, 9, 25, 98, 108, 127, 134, 129, 92, 136; 111/122, 131, 161

[56] References Cited

U.S. PATENT DOCUMENTS

| | | | |
|---|---|---|---|
| 3,316,977 | 5/1967 | Snook | 171/25 |
| 3,732,023 | 5/1973 | Rank et al. | 404/90 |
| 3,802,022 | 4/1974 | Fleming | 15/84 |
| 3,819,329 | 6/1974 | Kaestner et al. | 422/3 |
| 3,888,196 | 6/1975 | Glenn | 111/131 |

FOREIGN PATENT DOCUMENTS

| | | |
|---|---|---|
| 0115893 | 8/1984 | European Pat. Off. . |
| 0219440 | 4/1987 | European Pat. Off. . |
| 3147648 | 6/1983 | Fed. Rep. of Germany . |
| 3134522 | 8/1983 | Fed. Rep. of Germany . |
| 3209134 | 9/1983 | Fed. Rep. of Germany . |
| 7410350 | 10/1975 | France . |
| 2021947 | 12/1979 | United Kingdom . |
| 2071785 | 9/1981 | United Kingdom . |

OTHER PUBLICATIONS

Chemical Abstracts, vol. 100, No. 23, Jun. 4, 1984, p. 313, Abstract No. 188657E; Yu I. Grigor'ev et al.: "Effectiveness of Using Chlorine Produced by Electrolysis of Seawater as a Bactericide", 1984, (3).

Louis Vidal: "Dictionnaire Vidal", 1964, p. 2147, O.V.P., Paris, FR.

*Primary Examiner*—Dennis L. Taylor
*Assistant Examiner*—J. Russell McBee
*Attorney, Agent, or Firm*—Sandler, Greenblum & Bernstein

[57] ABSTRACT

A method and apparatus for disinfecting sand with an electrolysate of sea water, whose concentration of chlorine equivalent is 200–2000 mg/l before redepositing sifted sand back on to the beach.

15 Claims, 3 Drawing Sheets

| | Tractor Speed | Width of Engine | Depth Treated | Volume of Sand Treated / Hour | Vol. of Product Sprayed / Sand Treated = CONCENTRATION | Pump Flow |
|---|---|---|---|---|---|---|
| Electrolysate of sea water at 1000ppm of chlorine equivalent | 5 000 m/h | 2 m | 0.05 m (5cm)<br>0. 1 m (10 cm)<br>0.2m (20cm)<br>0.3 m (30 cm) | 500 m3/h<br>1 000 m3/h<br>2 000 m3/h<br>3 000 m3/h | 0.002 m3/m3 | 1 m3/h<br>2 m3/h<br>4 m3/h<br>5 m3/h |
| Electrolysate of sea water at 800 ppm of chlorine equivalent | 5000 m/h | 1.5 m | 0.05 m<br>0.10 m<br>0.20 m<br>0.30 m | 375 m3/h<br>750 m3/h<br>1 500 m3/h<br>2 250 m3/h | 0.0033 m3/m3 | 1.237 m3/h<br>2.475 m3/h<br>4.95 m3/h<br>7.425 m3/h |
| | 3 000 m/h | 1 m | 0.10 m<br>0.15 m | 300 m3/h<br>450 m3/h | 0.0033 m3/m3 | 0.99 m3/h<br>1.485 m3/h |
| Quaternary ammonium disinfectant solution | 5 000 m/h | 1 m | 0.05 m<br>0.1 m<br>0.2 m<br>0.3 m | 250 m3/h<br>500 m3/h<br>1000 m3/h<br>1 500 m3/h | 0.005 m3/m3 | 1.25 m3/h<br>2.50 m3/h<br>5 m3/h<br>7.5 m3/h |
| | | 1.5 m | 0.10 m<br>0.30 m | 750 m3/h<br>2250 m3/h | 0.005 m3/m3 | 3.75 m3/h<br>11.25 m3/h |
| Peracetic acid solution | 5 000 m/h | 1.5 m | 0.20<br>0.25 | 1 500 m3/h<br>1 875 m3/h | 0.004 m3/m3 | 6 m3/h<br>7.5 m3/h |

Fig- 7

APPARATUS FOR CLEANING SANDY OR PEBBLE-COVERED SITES

BACKGROUND OF THE INVENTION

1. Field of the Invention

The present invention relates to an apparatus to be used for the mechanical and chemical-bacteriological cleaning of sandy or pebble-covered beaches.

2. Discussion of Background and Material Information

As used herein, sandy of pebble-covered beaches are the plots comprising in their major portion free rock grains, of a size varying between 0.1 and 50 mm., situated generally along seas or lakes, i.e., places which are frequented more and more by vacationers.

The considerable development of industrial and in particular touristic activities along the coasts have caused pollution phenomena to appear: undesirable deposits of waste of all sorts, including contamination of sand or pebbles by the addition of approximately 30,000 exogenous pathogenic germs to the initial natural 4,000 germs per gram which are themselves normal in the natural equilibrium or environment of the beach. Besides the adverse aesthetic aspect of such pollution, pollution also presents dangers for visitors, dangers of wounds caused by sharp objects such as broken glass, and transmission dangers of illness and disease by microbial germs which find in sand a warm and humid environment suited for their proliferation.

In an effort to combat such problems sanitation authorities, national or local, sensitized by this problem, proceed to the regular cleaning of the coasts. As to one of the more visible forms of pollution, that of wastes, there currently exist various machines for performing this work. The most simple consists of a rake fixed with respect to the chassis in the work position, which one pulls by means of a tractor and which is regularly lifted to temporarily leave the pile in place.

One type of machine suitable for this purpose conveys wastes to a receiver bin during cleaning. A first type of machine comprises a series of combs affixed to a rotating conveyer which rakes a depth of approximately 5 cm. of sand. A second type of machine comprises an attack blade positioned in front lifting a layer of sand which varies as needed from 2 to 40 cm. This sand is projected by a drum provided with small wings towards a rotating screen conveyer to be sifted there. The movement of the conveyer also causes the lifting of wastes towards the receiving container. Once the sand has been sifted it falls back to the beach.

The attention of the sanitation authorities to the problems of the pollution of the coasts by the exogenic, pathogenic microorganisms is more recent, and as a standards and methods of cleaning are still relatively poorly defined.

A first method consists of spraying a powerful disinfectant, such as solutions comprising aldehyde or phenolic compositions, which render the sand which is reached antiseptic over the sand in conventional manner. These solutions have the advantage of remaining active for a long time, such that they continue their work while the sand is stirred up by the passage of summer visitors. Unfortunately, it appears that these disinfectants also exhibit secondary effects on human beings, and on the habitat because, they prevent the non-pathogenic microorganisms which are natural for the terrain from developing.

It has, consequently, been suggested to combine the mechanical cleaning and the chemical-bacteriological cleaning into a single machine. Thus, in the apparatus disclosed in German Specification 3,209,134 the particles are first heated and then disinfected by virtue of a powerful solution comprising 5–25% lactic acid and 0.2–1% quaternary ammonium. Unfortunately, this solution can cause secondary effects such as irritations on the skin of children.

In the specification of German 3,147,648 it is mentioned that any type of disinfectant solution, even deodorizing may be used, as a complement to the mechanical sifting of the sand in this machine. No consideration is given to the secondary effects of using an overactive cleaning agent.

German Specification 3,134,522, discloses injecting into the sand a high temperature gas, such as air, through teeth of a large rake to sterilize the sand. The use of overheated air as a cleaning agent effectively destroys all of the germs even those which are indigenous and necessary for the natural equilibrium of the beach.

A second method, considered to be relatively gentle is described in French Specification 85.15284 of F-TEC Corp., in this method a sea water electrolysate is used to disinfect the sand. This electrolysate is produced either in a fixed station or in a moveable unit pulled by a tractor before being sprayed by a row of sprayers. Once the disinfection work has been performed, this electrolysate is progressively retransformed into salts contained in the sea water under the action of ultraviolet solar rays, and as a result becomes inoffensive to the tourists. However, given that during the spreading the product remains on the surface while the germs responsible for the infections are also present at several centimeters of depth, this process still remains superficial and thus ineffective.

A more careful analysis of the behavior of a liquid in a pile of sand illustrates in fact two distinct situations: the "free" liquid and that which is "bound". One understands by free liquid that which fills the empty interstices between the grains. The ratio of this empty volume over the total volume of the rock is called the porosity whose typical value for the sand is 40%. This liquid volume is useless in the disinfection process. By bound liquid, it is understood the liquid which envelopes each of the grains of sand on which the microorganisms grow, liquid which is held by surface tension. Laboratory calculations on a volume of one cubic meter of sand show that there is required 400 liters of liquid to totally soak it while 4 liters are sufficient to make it wet. Yet, when one proceeds to spreading the liquid, one unnecessarily soaks the sand.

SUMMARY OF THE INVENTION

The present invention has as an aim an apparatus allowing for a more effective chemical-bacteriological cleaning of loose terrains, both on the surface and to a useful depth of 40 cm. It must allow for a spraying of a minimum quantity of fluid such that the majority of grains are wet, without unnecessarily soaking the terrain. Furthermore, the apparatus must be able to be easily adapted to mechanical cleaning machines to intervene in the course of operation without however interfering with their initial effectiveness.

This cleaning of sandy or pebbled terrain is achieved according to the invention by a material comprising means which disturb the ground in depth in the form of small particles and sea water electrolysation, the electroloysate whose concentration in chlorine equivalent is between 200 and 2,000 mg./l. The chemical-bacteriological cleaning intervenes while these particles are in movement, either projected into the air, or during their fall to the ground, and, in all cases, before their redeposition on the ground.

According to preferred embodiments, the chemical-bacteriological cleaning is performed by spraying a quantity of sea water electrolysate between 1 and 7 liters per cubic meter.

According to a first embodiment, the cleaning apparatus of the sifting type, comprises at least one drum having small wings, or a beater, projecting the harvested sand on a rotating screen conveyer or on a sieve; and the spraying means are positioned at the outlet of this drum or this beater to eject the liquid solution on the sand grains during their projection outside of the drum or during their fall on the screen or the sieve.

Preferably, the one or more sprayers, in flat jet spray, are mounted side-by-side and eject the liquid solution over the width and towards the bottom of the drum or beater.

According to a second embodiment, the cleaning apparatus is of the sifting type comprising a sieve or rotating screen conveyer to which is brought the sand, filtering it and retaining the wastes then conveyed towards a container. The chemical-bacteriological cleaning means are thus localized at the outlet of the sieve, over the passage of grains of sand during their individual fall towards the ground.

According to a first embodiment of the above-cited apparatus, the one or more sprayers are of the radial type, i.e., they eject the solution radially in a plane perpendicular to the fall of the sand grains.

According to a second embodiment, the one or more sprayers are mounted side-by-side on ramps and also eject the solution in a plane perpendicular to the fall of the grains of sand.

According to a third embodiment, the cleaning apparatus is of the power-driven cultivator type comprising one or more cogwheels penetrating and turning up the ground as well as spraying means positioned above the wheels and oriented downwardly.

BRIEF DESCRIPTION OF THE DRAWINGS

The invention is described below in a more detailed fashion with the aid of exemplary embodiments, without a limiting character, illustrated in the annexed drawings and tables, in which.

DETAILED DESCRIPTION

Figure 1:
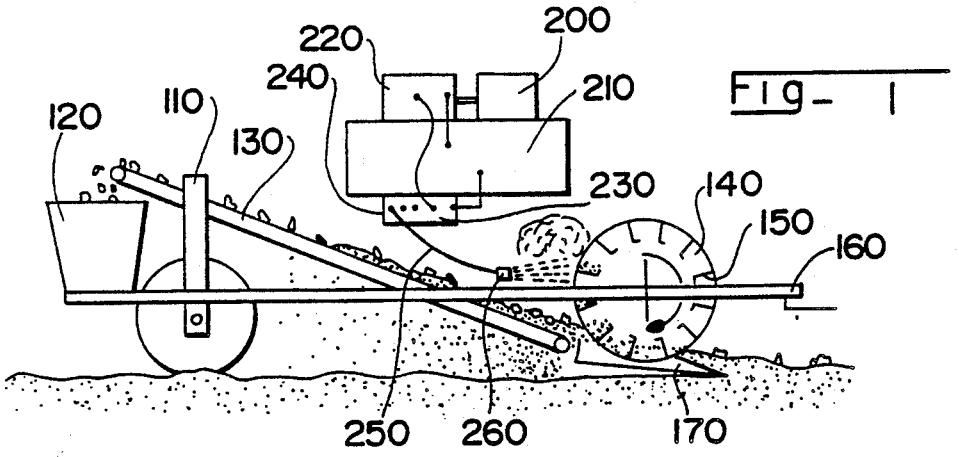
FIG. 1 illustrates a machine of the sifting type comprising a winged drum.

With reference to FIG. 1, the machine comprises a chassis 110 mounted on wheels which is pulled along the beach to be cleaned by a tractor. On this chassis is installed an attack blade 170 lifting the superficial layer of sand. The vertical position of attachment 160, imposed by the tractor, allows for the adjustment in height of the blade, thus allowing for the adjustment of thickness of the layer harvested for a value between 2 and 38 cm. This layer of sand is projected by means of a drum 140 provided with small transverse wings 150, otherwise called a beater, onto a rotating grill conveyer 130. This grid conveyer conveys the sand while bringing the wastes towards a container positioned at the rear 120.

The projection of the sand by the small wings 150 creates, at the outlet of drum 140, a cloud of grains of sand in ascending, descending and other movement knocking against one another. As shown in FIG. 1, sprayers 260 in a flat jet are oriented in the direction of the drum. One or more sprayers may be provided to cover substantially the entire width of the drum depending upon the quality of spray desired, i.e., either a coarse spray or a fine homogeneous spray and depending upon the type of nozzle utilized, i.e., either normal jet or wide flat jet, or eccentric flat jet.

After multiple tests on site, it has been found that it is useful to orient the flat jet toward the bottom of the drum and thus towards the bottom of the cloud of sand. In this case, even though this cloud is sprayed only on a single side, the mixing of the particles between them is sufficient to obtain a homogeneous wetting with a minimum quantity of liquid, for example, 2 liters only of sea water electrolysate per cubic meter of sand treated.

The product to be spread is initially stored in a reservoir 210. A turbine pump 220, having valves or pistons, of constant load or operation and animated by the motor group 200, feeds the regulator 230. This regulator automatically varies the return of the liquid into the reservoir 210 so as to maintain a constant pressure in pipeworks 250 and at the head of sprayers 260, pressure which is determined and displayed at the beginning of the cleaning operation. The shape as well as the dimensions of the spray nozzles being fixed, the regulation of the pressure thus assures a constant flow.

The sand, once it is chemically treated, falls on the grill belt 130 where it is strained before falling back to the ground. The wastes collected are conveyed towards a receiver container 120.

Figure 2:
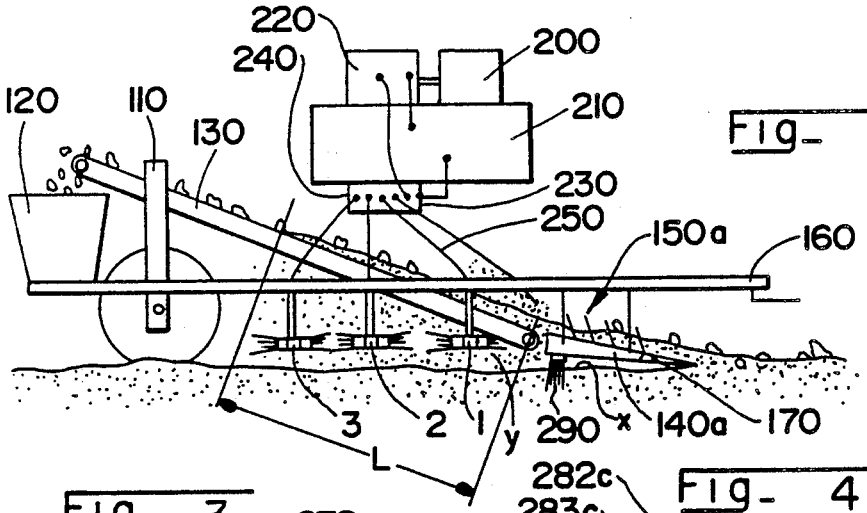
FIG. 2 illustrates a machine of the sifting type where the spraying means are positioned at the outlet of the sieve.

With reference to FIG. 2, the cleaning apparatus of the sifting type does not comprise a beater drum, instead a small conveyer **140*a*, having blades 150*a*. The sand is then directly brought to the strainer conveyer 130**. The screen of the sieve has a value of 1 cm., i.e., only wastes of dimensions greater than 1 cmr. are collected. The value of this screen thus conditions the velocity of passage of the sand through the sieve which coupled with the velocity of displacement of the strainer belt and quantity of sand to be treated, i.e., the thickness of the layer of sand removed, results in a length L of effective use of the conveyer. This length L multiplied by the width of the engine gives the surface A traversed by the sand during its fall to the ground.

A series of banks of sprayers 1, 2, 3 . . . of width identical to the conveyer, allows for the spreading of the chemical product in the plane A, perpendicular to the fall of the grains of sand. In an analogous fashion to the proceeding apparatus, the product to be spread is initially stored in reservoir 210. Pump 220 animated by motor 200, electrical or gas driven, sends the product under pressure towards the sprayers across regulator 230 and conduits 250. A series of faucets 240 makes it possible to select from among the banks those to feed. Thus, depending on the value of L, one utilizes the first two banks 1 and 2, or all three simultaneously.

Taking into account that a substantial portion of the sand is filtered on the first 50 cm. of the conveyer strainer, one expects a greater flow for bank 1 with respect to the following.

In the case of particularly polluted and/or frequented beaches, an advanced bank 290 allows for a more concentrated spreading of the product on the layer x situated at the base of the volume y of treated sand.

Figure 3:
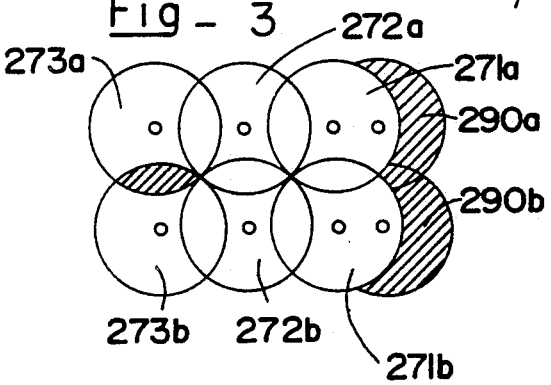
FIG. 3 illustrates a first embodiment of the sprayers for a machine according to FIG. 2.

A first configuration, shown in FIG. 3, in planar view, comprises circular sprayers 271*a* . . . 273*b* each mounted at the bottom of feed 2. This configuration has the advantage of simplicity of assembly, maintenance or during possible repairs, particularly during total or partial blockage of a sprayer. It has the disadvantage of a double useless sprinkling of sand grains in the zones z.

Figure 4:
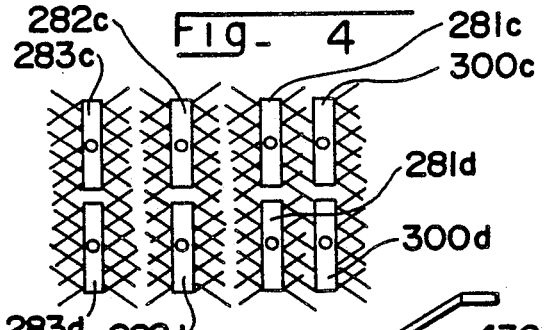
FIG. 4 illustrates a second configuration of the sprayers for a machine according to FIG. 2.

A second embodiment, shown in FIG. 4 in planar view, is constituted by bars 281*c* . . . 283*d* carrying 2–6 small sprayers per side. By adjusting the pressure of the pump 120, one thus obtains a uniform sprinkling surface without any zone of overlap.

Figure 5:
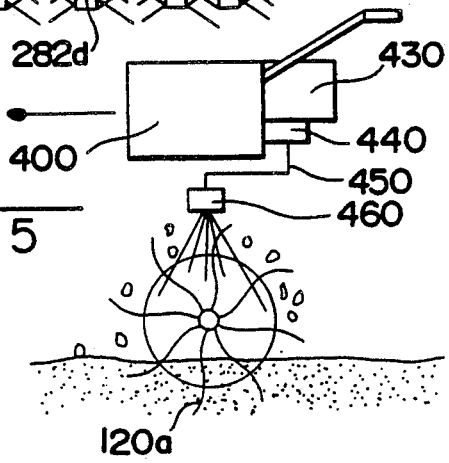
FIG. 5 illustrates a machine of the power-driven cultivator type, Table 1 illustrates different spray liquid flow rates with respect to the type of liquid and the thickness of the sand treated, and Curve 2 presents, in terms of density of germs, results showing the efficacy of the apparatus according to the invention.

In FIG. 5 is shown an apparatus for chemical-bacteriological cleaning alone, utilized preferably for small surfaces of sand allocated for child games. It consists of a power-driven cultivator of a conventional type on which are adapted above cogwheels 120*a* one or more sprayers 460 having a flat jet oriented towards the wheels, parallel to their axis. A small pump 440, directly attached and connected to motor 400 feeds the sprayers across tubes, solid or flexible, 450.

The power-driven cultivator is only utilized, within this context of the invention, to stir up and project the sand, thus creating a propitious situation for an efficacious wetting over a depth varying from 10–30 cm. of individual grains of sand by the liquid solution.

It has been determined as a result of multiple tests on land that, by use of this apparatus, a concentration of 3.3 liters of sea water electrolysate commercially sold under the name "MERACTIVE" per cubic meter of sand treated is sufficient to wet the grains of sand without superfluous soaking, this allowing for an efficacious treatment. The concentration in active species corresponds in this case to 800 mg./l chlorine equivalent. This value of concentration corresponds, for a velocity of displacement of the machine of 5 km/h cleaning over a width of 1.5 meters, at a flow of the pump of 1.24 $m^3/h$ for a layer of 5 cm., of 2.47 $m^3/h$ for a layer of 10 cm. and of 7.4 $m^3/h$ for a layer of 30 om. of treated sand. In the case of a solution of quaternary ammonium necessitating a concentration of 5 liters/$m^3$ of sand, this is equivalent to a pump flow of 3.75 $m^3/h$ for the treatment of a layer of sand of 10 cm., a flow of 11.25 $m^3/h$ for a layer of 30 cm. In the case of a peracetic acid solution, necessitating a concentration of 4 liters/$m^3$ of sand, this is equivalent to a pump flow of 6 $m^3/h$ for the treatment of a layer of sand of 20 cm., and a flow of 7.5 $m^3$ for a layer of 25 cm. FIG. 7 gives values of flow with respect to other parameters.

It becomes clear from this study that the use of sea water electrolysate necessitates on the average a smaller concentration of product per cubic meter of sand treated for an identical result, lightens in a general manner the strains imposed on the apparatus, thus correspondingly increasing its reliability and its lifespan.

It appears necessary to add, on machines of substantial size, which therefore treat large surfaces, a regulation of the flow of sprayed liquid. A regulation with respect to time can be simply performed by virtue of an automatic valve adjusting the quantity of liquid returning to the reservoir such that the pressure at the inlet of the nozzles remains constant. The dimension and opening of the nozzles being fixed once and for all, there results a constant flow. Thus, before beginning the cleaning operation the driver determines a flow of liquid necessary with respect to the average possible velocity on a given beach and the desired depth of sand to be treated by means of a chart or of the table annexed hereto. He calculates, with respect to the nozzles mounted on the machine, an operation pressure which he displays on the regulator and he proceeds with the cleaning.

It is also possible to mount on the spraying mechanism a more sophisticated regulation, comprising a sensor of the velocity of advancement of the tractor, a pressure sensor to the nozzles and an electronic calculator pre-programmed which sends commands to the valve controlling the return of the liquid to the reservoir. Thus, the flow of the liquid sent into the sprayer nozzles depends also on the variations of velocity due to the terrain and preserve even better the concentration of liquid per $m^3$ of sand treated.

Figure 6:
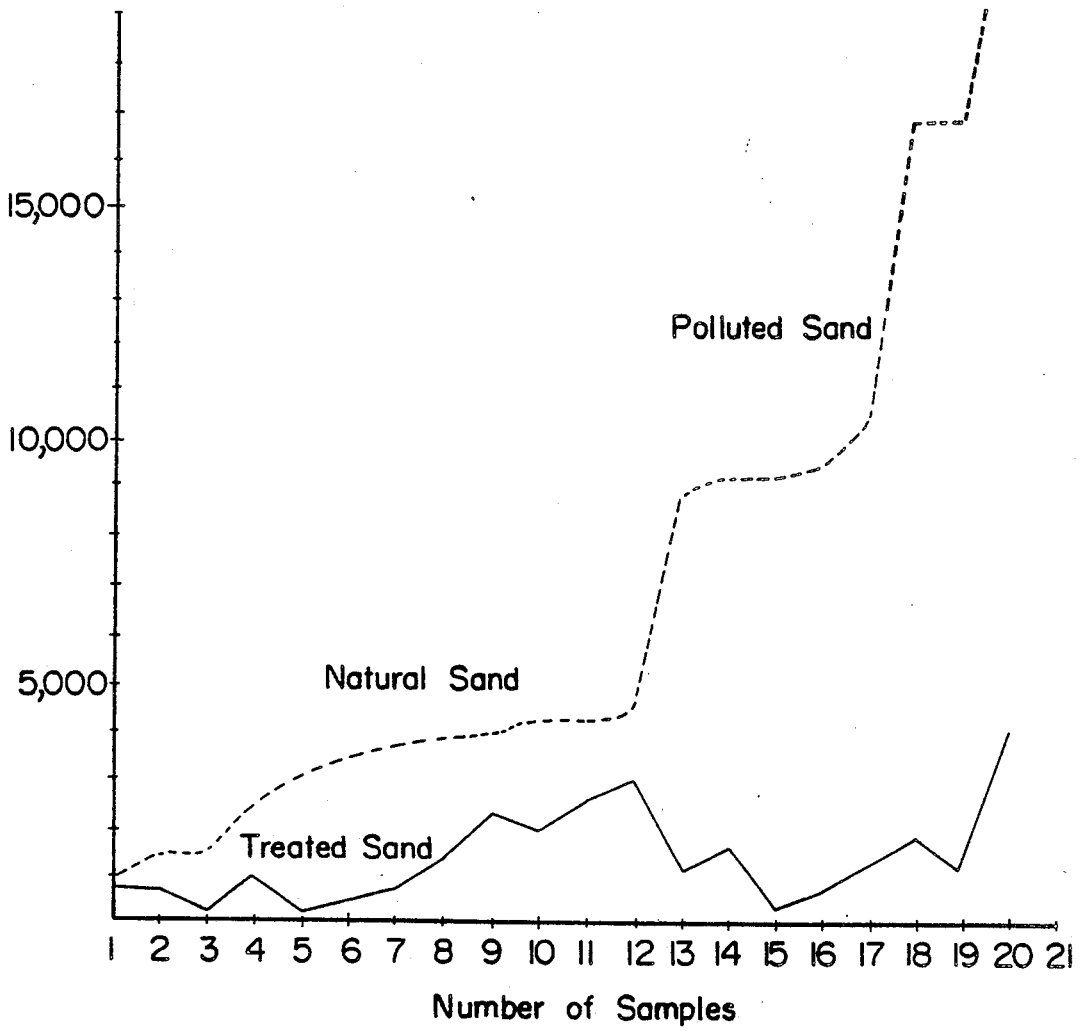

FIG. 6 presents at the ordinate the number of germs per gram before (cross-hatched curve) and after treatment (solid curve) for a slightly affected natural beach (Sample No. 1–11 in abscissa) and for a heavily polluted beach in the middle of a tourist season (Sample 12–20 in abscissa). One observed that, already useful without being really necessary for natural beaches, the use of the apparatus according to the invention is all the more interesting because it is both efficacious (division by 10 of the germs present corresponding to the almost total elimination of the exogenous germs) and without secondary dangers for persons visiting this beach.

As was presented in the course of this specification, the effectiveness of the chemical treatment in depth of the sandy terrain by spraying of sea water electrolysate is greatly improved by the use of means stirring up the soil in the form of small particles. Either the material is effected specifically by stirring up of the soil, such that the particular use of the power-driven cultivator or one takes advantage of a stirring up of the soil already required for another operation, in this case a mechanical cleaning of waste, to jointly perform the chemical cleaning. It should be noted that this chemical cleaning interferes very little with the effectiveness of the initial operation.

The apparatus according to the invention can be manufactured in the form of an autonomous assembly comprising the motor group, the pump, the regulator, the bundle of pipes and the sprayer nozzles, adaptable according to each type of mechanical cleaning material, able to be assembled and disassembled at will. Means can also be provided to directly connect the pump to an existing power source already on the receptor apparatus.

I claim:

1. An apparatus for cleaning soil containing at least one member selected from the group consisting of sand and pebbles, said apparatus comprising:

(a) means for removing a layer of top soil comprising particles from a group consisting of sand, pebbles and a mixture of said and pebbles to a predetermined depth from an area of land;

(b) means for projecting said particles in a cloud; and (c) means for applying a fluid comprising an electrolysate of sea water having a chlorine equivalent value within a range of 200 to 2000 mg/l to said particles in said cloud, operably positioned with respect to said means for projecting said particles, so as to envelope said particles with said fluid before depositing said particles on land.

2. The apparatus of claim 1, wherein said means for removing comprises a sifter.

3. The apparatus of claim 2, wherein said sifter comprises at least one drum having an outlet and means for projecting said particles as airborne particles from said outlet for better exposure to said fluid.

4. The apparatus of claim 3, wherein said means for applying is positioned adjacent said outlet to apply said fluid to said airborne particles.

5. The apparatus of claim 4, wherein said drum comprises a bottom and said means for applying comprise at least one sprayer for directing a spray of fluid towards said bottom of said drum.

6. The apparatus of claim 5, wherein said means for applying comprises a plurality of sprayers mounted side-by-side for directing said spray of fluid across the width of said drum.

7. The apparatus of claim 6, wherein said sprayers are flat jet sprayers.

8. The apparatus of claim 1, wherein said means for removing comprises means for collecting said particles.

9. The apparatus of claim 8, further comprising a container and wherein said means for collecting comprises a grid conveyer having openings to permit depositing said particles on land.

10. The apparatus of claim 9, wherein said means for applying is positioned adjacent said grid conveyer.

11. The apparatus of claim 10, wherein said means for collecting comprise means for filtering debris and waste from said particles, means for conveying said debris and waste to said container, and means for depositing said particles on land.

12. The apparatus of claim 11, wherein said means for depositing comprises an outlet for said particles to fall back to the ground and said means for spraying are positioned adjacent said outlet for applying said fluid while said particles fall back to the ground.

13. The apparatus of claim 12, wherein said means for spraying comprises at least one radial sprayer for ejecting said fluid radially in a plane substantially perpendicular to a direction of said particles falling back to the ground.

14. The apparatus of claim 12, wherein said means for spraying comprises a plurality of sprayers mounted side-by-side on banks for ejecting said fluid in a plane substantially perpendicular to a direction of said particles falling back to the ground.

15. The apparatus of claim 1, wherein the quantity of electrolysate of sea water sprayed is between 1 and 7 liters per $m^3$ of said particles.

* * * * *

UNITED STATES PATENT AND TRADEMARK OFFICE

CERTIFICATE OF CORRECTION

PATENT NO. : 4,993,498

DATED : February 19, 1991

INVENTOR(S) : Jean-Marie FRESNEL

It is certified that error appears in the above-identified patent and that said Letters Patent is hereby corrected as shown below:

At column 1, line 56 insert --result--- after "a".

At column 2, line 7 insert --of sand and pebbles--- after "particles".

At column 5, line 3 change "proceeding" to ---preceding---.

At column 7, line 6 (claim 1, line 6) change "said" to --sand--.

Signed and Sealed this

Fourteenth Day of September, 1993

Bruce Lehman

*Attest:*

BRUCE LEHMAN

*Attesting Officer*

*Commissioner of Patents and Trademarks*